United States Patent [19]

Audren et al.

[11] Patent Number: 4,928,898

[45] Date of Patent: May 29, 1990

[54] COMPRESSION COILING MACHINE

[75] Inventors: Yves Audren; Guy Tuffal, both of Orange, France

[73] Assignee: Isover Saint-Gobain

[21] Appl. No.: 201,863

[22] Filed: Jun. 3, 1988

[30] Foreign Application Priority Data

Jun. 3, 1987 [FR] France ..... 87 07731

[51] Int. Cl.[5] ..... B65H 18/16

[52] U.S. Cl. ..... 242/55.1; 242/66; 242/DIG. 3

[58] Field of Search ..... 242/66, 67.1 R, 75.1, 242/55.1, DIG. 3

[56] References Cited

U.S. PATENT DOCUMENTS 3,991,538 11/1976 Finn et al. ..... 242/DIG. 3 X 4,475,696 10/1984 Birch et al. ..... 242/66

*Primary Examiner*—John M. Jillions

[57] ABSTRACT

Strips of mineral fibers are brought into a space defined by three members operated by a movement which drives the coiling of the strip. The third of these members, the compressor roller, is operated at a rotational speed which is a function of a predetermined program while introducing as parameters the length of the strip which has already been coiled and the speed of the feeding conveyor of the strip. The rolls obtained are cylindrical and there are no overcompressed zones.

16 Claims, 4 Drawing Sheets

FIG_1
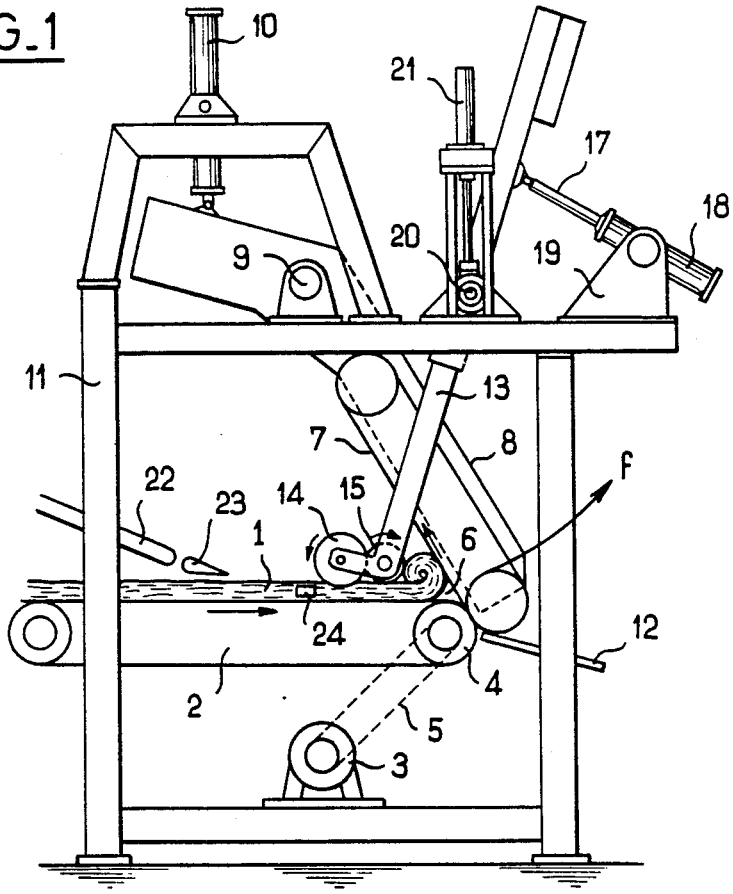
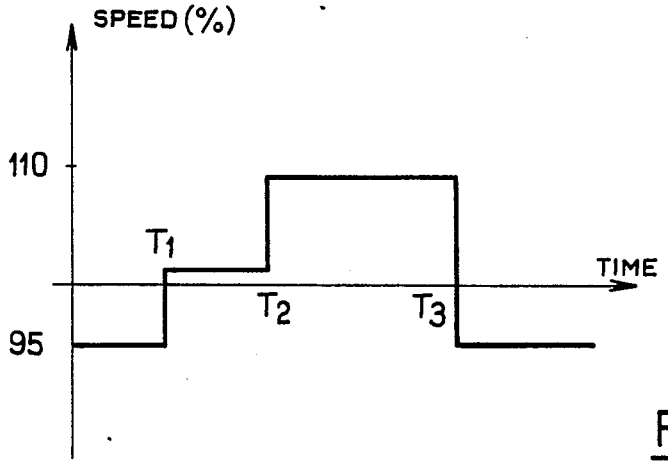
FIG_5

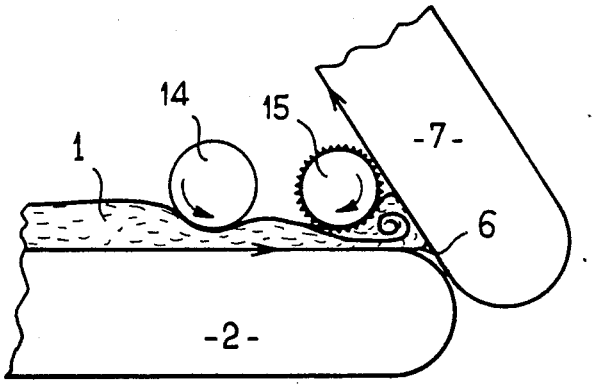
FIG. 2.2
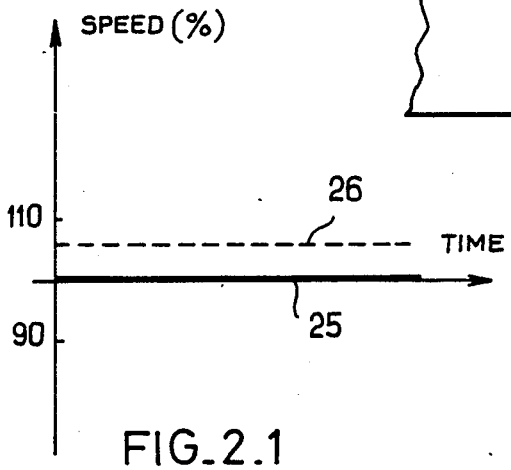
FIG. 2.1
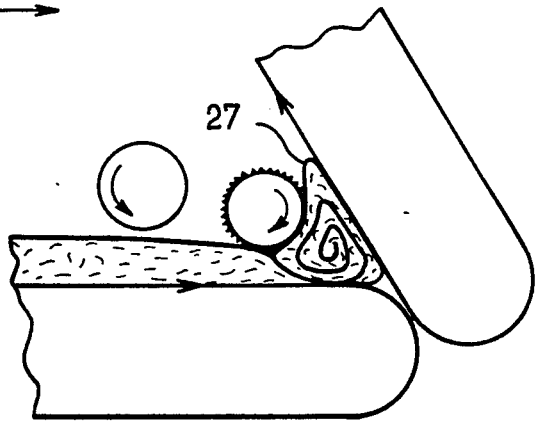
FIG. 2.3
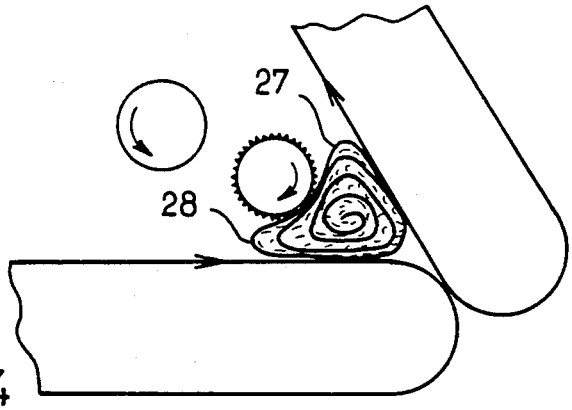
FIG. 2.4

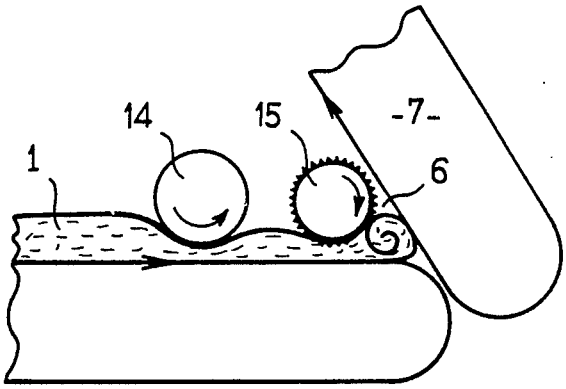
FIG. 3.2
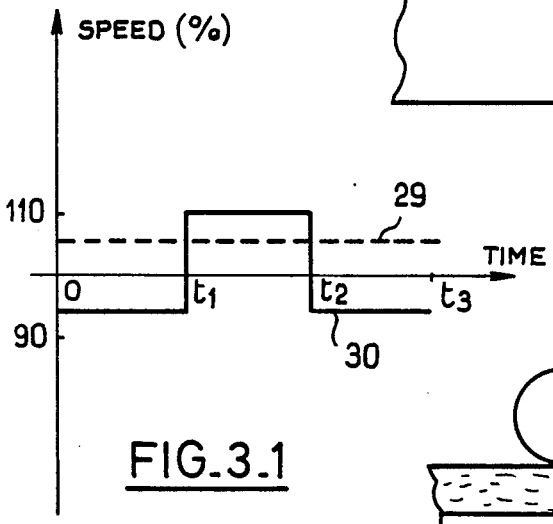
FIG. 3.1
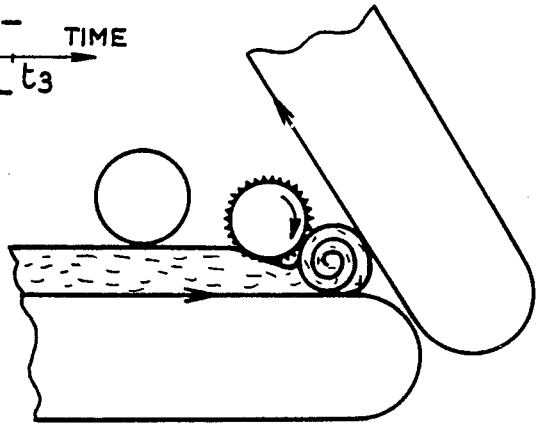
FIG. 3.3
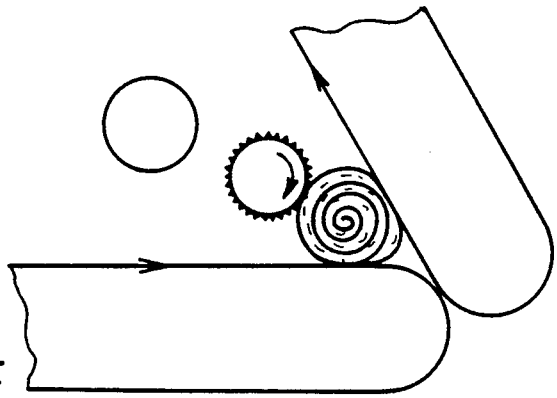
FIG. 3.4

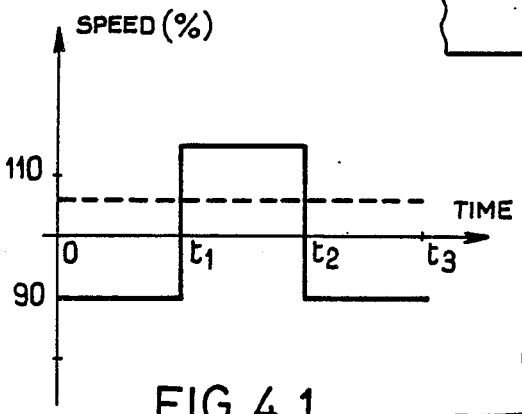
FIG_4_1
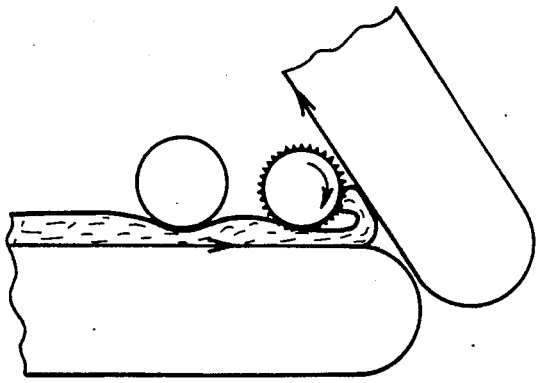
FIG_4_2
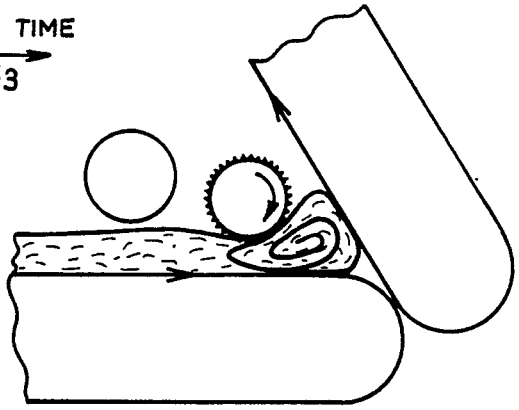
FIG_4_3
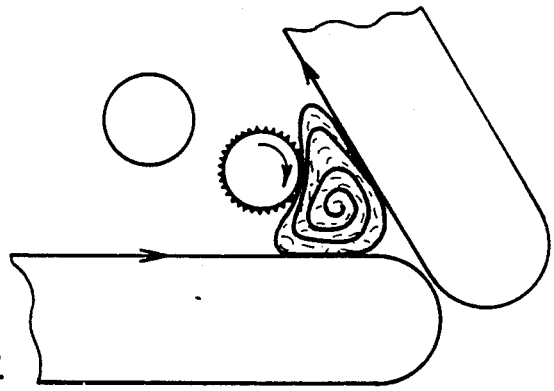
FIG_4_4

COMPRESSION COILING MACHINE

BACKGROUND OF THE INVENTION

1. Field of the Invention:

The object of the invention is an improvement in the process of forming rolls from strips of compressible materials, particularly strips of felt with a mineral fiber base, which are designed for the thermal and/or sound insulation of buildings.

2. Background of the Related Art:

The felt strips which are made up of mineral fibers, particularly glass fibers, associated with a resin which is normally of a formo-phenolic type are used in a standard manner for the insulation of roofs, walls or floors. As the thermal resistance of a material is proportional to its thickness, modern requirements have resulted in the marketing of thicker and thicker products of between 7 and 16 cm and even of 25 cm in thickness. As glass fibers with a very low thermal conductivity and which are particularly fine have also been developed recently, strips of felt of a low density and which are thicker have to be processed.

Normally, the processing consists of coiling the strip of felt under compression so as to form a cylindrical roll, the subsequent unrolling of which is prevented by means of a paper or plastic cover. A device for carrying out this process is for example described in U.S. Pat. No. 4,583,697 in which coiling is effected in a space defined by three members: the feeding conveyor; a vertical conveyor or roller, the felt contact surface of which forms with the feeding conveyor an angle of the order of 40°–80°, preferably in the region of 60°, and a compressor roller which is progressively moved away so as to increase the size of the space as the coiling operation progresses and which is driven by a rotational movement in the opposite direction in relation to the direction of feed of the vertical conveyor.

According to the teaching of the above-mentioned patent, the coiling operation is more uniform over the length of the strip if the compression applied by the the felt is not the result of a passive action but on the contrary the displacement of the compressor roller is controlled according to a predetermined program so as to impose on each turn of coiled felt a given thickness, which preferably is constant or which is reduced slightly as the coiling operation progresses. The parameters selected for the program are preferably the length of the coiled spring and its initial thickness.

By carrying out the operation in this way, a more uniform compression is achieved over the complete length of the felt strip and because of this, a more uniform resumption of the thickness after unpacking is also achieved; this makes it possible to operate with the maximum compression ratio to which the product can be subjected and to apply a simplified processing operation.

In addition to the need for a controlled compression, it is also necessary for the turns of the felt to be satisfactorily tensioned. If the felt is not correctly tensioned by the compressor roller, rolls which do not comply with the specifications are produced on industrial processing lines, the diameters of which are greater than the nominal diameter or the rolls are truncated and not cylindrical. The rolls which do not meet their specifications do not facilitate subsequent processing operations, particularly the formation of bundles and the unloading of such bundles by means of automatic systems. It has been shown in U.S. patent application No. 07/024,600 that these difficulties are essentially attributable to the surface condition of the compressor roller and in this publication it is proposed to replace the carved covering of the rubber type, which is normally used for the compressor roller, with an inorganic covering which is resistant to abrasion and which forms rough areas. This preferred covering consists of an initial layer of molybdenum deposited by Schoop's metal spraying process, onto which is deposited again by this metal spraying process a second layer consisting of grains of, for example, corundum, the thickness of which does not exceed a millimeter. In addition to these small rough areas, the surface which comes into contact with the felt is preferably provided with patterns arranged in a regular manner, of 2 to 10 mm in depth and spaced with clearances of 20 mm at the most.

A compressor roller of this type has a useful life of more than 500 hours as compared with the 150 operating hours generally obtained with rubber coverings. The wear is thus very considerably reduced and the variations in the surface condition of the roller can be controlled much more satisfactorily over a period of time so that it is possible to compensate for it at least partially by altering the speed of the compressor roller in relation to the speeds of the two conveyors, in practice by accelerating the compressor roller.

However, the results are not yet perfectly satisfactory and the greater the speed of the compressor roller, the more the shear phenonema are increased in the product and so the more it deteriorates. A deterioration of this type, even if it is held within the tolerances, does not allow the use of constant parameters. On the other hand, if it is desired to automate the subsequent operations of handling the rolls in a fairly simple manner, it is essential that their dimensions continue to be identical.

Moreover, the inventors have shown that the quality of the coiling is not in accordance with closely defined quality criteria even when the roughness of the compressor roller is perfectly constant and the compression is regulated in accordance with the teaching of U.S. Pat. No. 4,583,697. It has been observed first of all when high compression ratios of acceptable levels according to the capacity for compression of the mineral fiber and its elasticity, are applied to the leading part, the felt is damaged to a greater or lesser degree and the compressor roller splits the felt or separates the craft paper coating designed for use as a vapor shield. To overcome these difficulties the compression ratio has to be reduced so that as far as the process is concerned, some of the advantages associated with the exceptional quality of the fibers are lost.

Another disadvantage is found when coiling strips of felt, for example of 160–200 mm thickness, which are short in length (4–7 meters long). Under these conditions the thickness of the final coiled turn becomes not inconsiderable in relation to the diameter of the roll which is then of hellicoidal and not of circular section. If the positioning of the cover holding roller is not perfectly synchronized, a situation which cannot be systematically assured because of the very rapid throughputs, it can happen that the covering zone and the fixing of the cover with adhesive coincides in addition with this lack of alignment of the last coiled turn which creates a weakness in the packing.

SUMMARY OF THE INVENTION

The object of the present invention is an improvement which does not have the above-mentioned disadvantages, in the processes for forming rolls from strips of compressible materials, in particular those made of strips of glass wool. According to this process the strip of material is brought continuously into a space defined by three members operated by a movement which drives the coiling of the strip onto itself in succession on coming into contact with each of the members, the third of these members being a compressor roller which is driven in rotation and in addition displaced according to a predetermined program so as to increase progressively the space available for the roll being formed. The new feature of this process is that the speed of rotation of the said compressor roller is a function of a predetermined program which introduces as parameters the length of the strip which has already been coiled and the speed of the feeding conveyor of the strip (first member in contact with the strip).

Preferably, the compressor roller speed curve is in accordance with a function in stages of the coiling time, the speed of the compressor roller being chosen to be less than the speed of the feeding conveyor during the phase of forming the core of the roll and greater than the said speed of the feeding conveyor during the coiling phase proper. During the final phase of packing and smoothing the roll, the speed of the compressor roller is preferably again less than the speed of the feeding conveyor of the strip.

The coiled strip forming the core of the roll for preferably does not exceed 30% of the total length of the coiled strip, while the smoothing period is preferably after the complete coiling of the strip and corresponds to the positioning of the paper or plastic protection cover. This smoothing operation enables an improved shape of the rolls to be achieved and also makes it possible to apply in an effective manner the part of the covering to which adhesive has been applied in advance.

By continuing the process according to the invention, perfectly cylindrical rolls are obtained which are above all remarkable from the point of view of the quality of coiling of the initial turns of the felt, i.e. the turns forming the core.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a schematic view of a conventional coiling machine for the application of the invention;

FIG. 2.1 through 2.4 show views of a strip of glass wool in the process of being coiled, when the speed of the compressor roller is held constant (FIG. 2.1), during the phase of forming the core (FIG. 2.2), during the phase of coiling proper (FIG. 2.3) and during the smoothing phase (FIG. 2.4);

FIGS. 3.1 through 3.4 show views which correspond to those of FIG. 2.1 through 2.4, respectively, with the compressor roller having a speed which is controlled according to the invention;

FIGS. 4.1 through 4.4 show views corresponding to those of FIGS. 2.1 through 2.4 and 3.1 through 3.4, respectively, for another method of regulating the speed of the compressor roller according to the invention; and FIG. 5 shows a third method of regulating the speed of the compressor roller according to the invention.

DETAILED DESCRIPTION OF THE PREFERRED EMBODIMENTS

FIG. 1 shows a schematic view of a coiling machine according to the teaching of U.S. Pat. No. 4,583,697. The strip of mineral fibers, which preferably is made of glass wool, is produced in a manner well known to those skilled in the art, for example by centrifuging molten glass and the gaseous drawing of the formed filaments. The fibers are impregnated with a thermosetting binder, preferably before being collected by a conveyor under vacuum which transfers the strip which has been formed in this way to a polymerization oven. On leaving the oven the borders of strips are cut and the strip is fed in length and width sections of dimensions chosen in relation to the intended use of the product. Where applicable a sheet of kraft or aluminized paper is stuck over a surface of the strip of glass wool so as to form a vapor barrier. Although the method of manufacturing the fibers is in itself of no importance as far as the invention is concerned, it should nevertheless be noted that light felts, the density of which does not exceed 30 $kg/m^3$ are generally produced with very large throughputs of for example 160 metric tonnes of fibers a day. With throughputs of this type, the speeds of the coiling conveyors should be of the order of 100 meters per minute and sometimes reach a speed of more than 120 meters per minute. This means that the coiling of the strip of glass wool and the packing of the roll in a protective covering must be carried out at the same speeds, speeds which rapidly show up all the defects of the process. It is of course possible to use several coiling machines, but the maintenance costs and the cost of labor are increased proportionally.

The felt made of glass wool 1 is transferred to the feeding conveyor 2 of the coiling machine, which preferably consists of an endless belt driven by a motor 3 which transmits its power to the drum 4 by means of a transmission belt 5. The felt is thus conveyed in the direction of the arrow as far as a defined space 6. The conveyor 2 is preferably equipped with a depression box which is not shown here and which prevents the felt from slipping.

The felt then comes into contact with a second conveyor 7 which forms an angle of between 40° and 80°, and preferably of the order of 60°, with the feeding conveyor 2. The movement of the conveyor 7 is also controlled by the motor 3 by means of a deformable transmission belt which is not shown here. The conveyor 7 can be retracted in the direction of the arrow "f" by rotating its carrier arm 8 about the axis 9 by means of a jack 10 supported by the upper part of the frame 11 of the coiling machine in such a way as to release the roll from the space 6 after it has been packed in a protective covering, whereby the roll then falls onto the inclined plane 12 before being picked up by other conveyors for the palletizing operations.

The frame 11 also supports two arms 13, between which is mounted the carrier arm 8 and between the ends of which two rollers 14 and 15 are fixed, the rollers 14 and 15 being rotated in opposite directions to each other; roller 15 is known as the compressor roller which opposes the forward movement of the felt 1 and thereby forcing it to be coiled.

The arm 13, which is extended by counterweight 16, is displaced by means of the arm 17 of an articulated jack 18 on the bracket 19, while the shaft 20 of the arm 13 has an initial height which is regulated by a screw motor 21.

The feeding components for the protective coverings to which adhesive has been applied in advance, have also been shown in FIG. 1; these components are passed in the known manner from a conveyor 22 to belts 23 which deposit the covering in the defined coiling space.

The above-mentioned components of a coiling machine are only given by way of example and can be replaced by equivalent components without departing from the scope of the invention. Thus the vertical conveyor 7 may be replaced by a wide diameter roller although this is not preferred as the surface in contact with the felt strip is then reduced.

In accordance with the teaching of U.S. Pat. No. 4,583,697, the jack 17 controlling the displacement of the compressor roller 15 operates in accordance with a predetermined program which uses as a parameter the length of felt strip which has already been coiled, a length which is identified at each moment by a sensor 24. Other sensors which are not shown here measure the position of the compressor roller and the speed of the feeding conveyor 2.

In a manner which is also preferred and in accordance with the teaching of U.S. Pat. No. 4,765,554, the compressor roller 15 has its surface which is in contact with the felt covered with an inorganic coating which is resistant to abrasion, which forms rough areas and which preferably consists of corundum grains deposited by a Schoop's metal spraying process onto a molybdenum base. The surface which comes into contact with the felt consists preferably of a series of bars screwed onto the roller and covered in the manner indicated above. A compressor roller of this type has good adhesion on the felt even when covered with a vapor shield and also only deteriorates very slowly.

However, the the present inventors have found that the results are not always satisfactory even when operating with a compression curve and with a compressor roller having a good surface condition. An example of a defect has for example been shown in an exaggerated manner in FIGS. 2.1–2.4.

FIG. 2.1 shows during the processing time of a roll of felt, the speed of the compressor roller 15 (line 25) and that of the vertical conveyor 7 (dashed line 26). The values of the ordinates correspond to percentages of the speed of the feeding conveyor, a speed which as mentioned above is measured at each moment and is used as a reference. The operation is carried out here in accordance with the art at a speed of the vertical conveyor which is 5% greater than that of the feeding conveyor and with a compressor roller revolving at a constant speed which is equal to that of the feeding conveyor.

FIG. 2.2 shows an enlarged view of the device in the coiling space of zone 6 at the very beginning of the coiling operation. The felt 1 progresses towards the zone 6, shown here at its smallest, while the counter-roller 15 has not yet begun to be moved away. During its movement the felt 1 first strikes against the roller 14 which forces the felt towards the coiling zone and powerfully compresses it. As soon as it is no longer in contact with this roller 14, the felt, thanks to its resilience, instantaneously regains a part of its volume although it is immediately taken up again by the compressor roller 15. As the latter rotates at the same speed as the feeding conveyor 2, the surface layers of the felt have a tendency to separate (since the upper layers, which move up and down during compression and relaxation, travel a greater distance than do the lower layers), which is particularly harmful when the felt is provided with a vapor shield covering. It should be pointed out, however, that the compression action applied by the roller 15 makes it possible to reduce this harmful effect to a large extent.

As the coiling operation progresses, the roller 14 is moved away as is shown in FIGS. 2.3 and 2.4. There is therefore no longer any need to fear a disintegration. On the other hand even if the grip by the compressor roller 15 is of good quality, the roll which is in the process of being shaped has a slight tendency to follow the vertical conveyor 7, which is moving more rapidly and a peak 27 is formed.

When the complete strip of felt is coiled (FIG. 2.4) and the protective covering of the roll is applied, it is found that the roll has a second forward point 28 in the direction of the felt 1 fed by the feeding conveyor 2. This forward point 28 is due to the inadequate compression of the final coiled felt turn or to the excessive speed of the compressor roller.

While bearing in mind, however, that the signs of interruptions in the coiling have been largely exaggerated in these diagrams, a roll is finally obtained, the section of which is not circular but has the appearance of a star with three branches. If this phenonemon is fairly marked, the mechanical properties of the felt will deteriorate as a result of these distortions, particularly from the point of view of its fatigue and shear strength. Moreover, the finished rolls can be slightly conical which raises handling problems. Another more serious disadvantage is that the felt is not compressed at all points in an identical manner, but has overcompressed zones, on which the resumption of the thickness after unpacking is less than that of the other zones. Certain settings on the production line then have to be changed either to adjust the excess thickness given to the felt or to increase its density or the fineness of the fibers used.

These disadvantages are eliminated if action is taken in accordance with the invention as shown in FIGS. 3.1–3.4. As shown in FIG. 3.1, the speed (curve 29) of the vertical conveyor 7 is maintained at a constant level and is 5% greater than the speed of the feeding conveyor 2, which is always used as a reference value. On the other hand, the speed of the compressor roller 15 (curve 30) is altered in relation to the progress of the coiling operation and reference conveyor speed.

In the simplest case shown here, the alteration is carried out over three periods. From time 0 to time $t_1$ (FIG. 3.2), the speed $V_1$ of the compressor roller is held slightly below the speed $V_2$ of the feeding conveyor 2. Good results are obtained however, with a speed $V_1$ which is equal to approximately 95% of $V_2$ during this first phase. Because of this, the compressor roller has slightly less adhesion on the product even at very high compression ratios. In this way the disintegration of the leading edge of the felt and the possible creasing of the vapor shield is prevented. The product is thus braked by the compressor roller and certainly has the time required for rolling on itself. The core of the roll, about which the following turns are coiled, is thus formed during this starting-up phase and during this initial phase of coiling from 5% to 30% of the length of the strip.

Between the time $t_1$ and time $t_2$ (FIG. 3.3), the speed $V_1$ of the compressor roller is significantly increased and fixed at between 105 and 110% of the speed $V_2$ of the feeding conveyor. This variation in the speed can be achieved by associating a frequency variation unit and an analog card controlling it with an AC motor operating the roller. This AC motor can be replaced by a compressor DC motor having a constant torque, the response time of which is advantageously more rapid. This second phase at a higher speed is completed at time $t_2$, when the complete strip has been coiled. As the core of the roll has been perfectly formed in the first phase, a powerful compression of the turns is then possible without any danger of the felt roll being misshapen. Moreover, with the compressor roller operating at this higher speed, it is possible to compensate for any slippage of the strip on the feeding conveyor 2, a slippage which could otherwise result in the formation of folds.

During this second phase, the strip 1 is completely coiled after which the operation of packing the roll in a plastic covering is then carried out in a third phase from time $t_2$ to time $t_3$. During this third phase, the speed $V_1$ of the compressor roller is again reduced to approximately 95% of the speed $V_2$ of the feeding conveyor and in this way the speed of rotation of the covering is slowed down and the covering is held tensioned so that a satisfactory smoothing of the felt roll is achieved. This also makes it possible to reduce the distortion of the rolls in the case of products with a large thickness, on which it is difficult to flatten the final turn satisfactorily. This final phase of between time $t^2$ and time $t^3$ takes place preferably during a period corresponding to at least three complete revolutions of the felt roll. This slowing down causes a considerable difference between the speed of rotation of the felt roll and the speed of the compressor roller, which facilitates the removal of the felt roll via the inclined plane 12 as soon as the conveyor 7 has been retracted.

As is shown more particularly in FIG. 3.4, the roll obtained consists of uniform turns, which are coiled about generatrices of concentric cylinders.

To test the efficiency of a process of this type for forming rolls, strips of glass fibers of 11 m in length, 1.20 m in width and 80 mm in thickness were coiled and rolls of 500 mm in diameter were formed corresponding to a compression ratio of 4.5. The strips were then unrolled and cut into squares. If the procedure according to state of the art (FIG. 2) or according to the invention is carried out, a resumption of the average thickness of 129% is obtained in both cases. On the other hand, the dispersion of the measurements is much greater in the first case (deviation type 8.5) than in the second (deviation type 6.8), which shows that the coiling conditions are much more stable according to the invention. It is possible to reduce slightly the grams per square meter density whereby the resumption of the thickness should not under any circumstances be less than 105% of the nominal thickness and the rolls are much more uniform, which simplifies transportation, storage and handling operations using for example robots.

As mentioned above the speed of the compressor roller varies according to the coiling phases between 95 and 110% of the speed of the feeding conveyor. These values represent critical limits as is shown in FIGS. 4.2, 4.3 and 4.4. The variation of the compressor roller speed over time has again been illustrated (FIG. 4.1). During the start-up phase, the speed of the compressor roller was chosen to be of the order of 90% of the speed of the feeding conveyor and as shown in FIG. 4.2, the strip of felt does not then tend to roll on itself but on the contrary the strip grips onto the conveyor 7 and tends to leave the coiling zone. The forward section of the strip is subjected to powerful tensions and a properly dense core is not formed for the rest of the operations. If during the second phase, the speed of the compressor roller is very significantly increased and rises to approximately 115% of the speed of the feeding conveyor, the adhesion of the compressor roller is then extremely large and the roll which is in the process of being formed has an almost triangular shape, a shape which is further accentuated during the smoothing phase if the speed of the compressor roller is again reduced considerably (90% of $V_2$).

According to the embodiment of the invention proposed on the basis of FIG. 3, the rotational speed of the compressor roller follows a three stage program, i.e. an initial phase, a coiling phase and a final smoothing phase. Although this is a simplified type of control of the speed of the compressor roller, it already enables a considerable improvement to be achieved in the quality of the coiling operation. It is preferable, however, to operate in a rather more complex manner by following the speed variation shown diagrammatically in FIG. 5 with a minimum of four stages.

Over an initial time (from 0 to $T_1$) the speed of the compressor roller (initial speed) is for preference equal to 95% of the speed of the feeding conveyor. As in the case illustrated in FIGS. 3.1–3.4. This speed is held for the time required to form a core of the roll which is perfectly shaped and on which the subsequent turns can be coiled. In the case of the strips of felt known as short strips (4 to 7 meters), approximately 30% of the length of the strip is coiled at this initial speed, while in the case of longer strips, the core is preferably formed by approximately the first two meters of the strip. The front edge of the strip of felt then does not have any separations and all tearing or creasing of the vapor shield is avoided.

The coiling phase proper which is effected over two periods, then begins. From time $T_1$ to $T_2$ the speed of the compressor roller is chosen equal to or slightly greater than (105%) the speed of the feeding conveyor, which allows a progressive increase in speed, while an abrupt acceleration could cause damage to the felt. Approximately 20% of the length of the strip is coiled in this way and this coiling phase is continued from time $T_2$ to $T_3$ until the complete coiling of the strip has been achieved, the operation being carried out at a high compressor roller speed of between 105 and 110% of the speed of the feeding conveyor. If a variable speed drive is provided which enables this to be achieved, the changeover from the initial speed to this high speed by coiling can be carried out not in a single stage ($T_1$ to $T_2$) but in a succession of stages and even continuously.

Once the strip has been coiled, the packing and smoothing operation of the formed roll is carried out; this is done at a reduced speed of the compressor roller of approximately 95% of the speed of the feeding conveyor. On completion of this fourth stage, the compressor roller can still be braked abruptly and this enables the moment of ejecting the packed roll to be fixed very precisely.

The precise fixing of these speed variations should be carried out for each type of product by specialist personnel, so that it is advantageous to associate the means of storage and automatic reminders of the different established speed curves. In addition, these curves can advantageously take account of a wear factor of the compressor roller, the speed of which will be systematically reduced if its rough areas are too sharp, which is the case with a new roller which has been badly deburred, but increased when the coating of the roller becomes less adhesive because of the wear on it.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for forming rolls from strips of compressible materials, comprising the steps of:

feeding a strip of compressible material to a space defined by three rotatable members, one of said members being the first to contact said strip and another of said members comprising a compressor roller which is movable so as to progressively increase the size of said space, said members comprising means to cause said strip to coil upon itself so as to form a roll; and driving said compressor roller during the coiling of said strip at speeds $V_1$ determined as a variable function of a driven speed $V_2$ of said one member and as a function of a length of said strip which has already been coiled, wherein $V_1 < V_2$ during at least one phase of the coiling of said strip.

2. The process of claim 1, wherein said at least one phase comprises an initial phase of coiling a core of said roll, after which $V_1 > V_2$ during a remainder phase of a coiling of said roll.

3. The process of claim 1, wherein said at least one phase comprises a final phase of packing and smoothing said roll.

4. The process of claim 2, wherein said at least one phase further comprises a final phase of packing and smoothing said roll.

5. The process of claim 2 wherein said initial phase corresponds to no more than an initial 30% of the length of said strip.

6. The process of claim 3, including the step of positioning a protective covering on said roll during said final phase.

7. The process of claim 4, including the step of positioning a protective covering on said roll during said final phase.

8. The process of claim 2, wherein $V_1 \geqq 95\%$ of $V_2$ during said initial phase.

9. The process of claim 4, wherein $V_1 \geqq 95\%$ of $V_2$ during said initial phase.

10. The process of claim 2, wherein $V_1 \leqq 110\%$ of $V_2$ during said remainder phase of coiling of said roll.

11. The process of claim 4, wherein $V_1 \leqq 110\%$ of $V_2$ during said remainder phase of coiling of said roll.

12. The process of claim 9, wherein $V_1 \leqq 110\%$ of $V_2$ during said remainder phase of coiling of said rolls.

13. The process of claim 2, wherein said remainder phase of coiling of said core comprises at least two stages including an initial stage wherein $V_1$ is between 100% and 105% of $V_2$ during a coiling of approximately 20% of the length of said strip, and a second stage wherein $V_1$ is between 105% and 110% of $V_2$.

14. The process of claim 4, wherein said remainder phase of coiling of said core comprises at least two stages including an initial stage wherein $V_1$ is between 100% and 105% of $V_2$ during a coiling of approximately 20% of the length of said strip, and a second stage wherein $V_1$ is between 105% and 110% of $V_2$.

15. The process of claim 9, wherein said remainder phase of coiling of said core comprises at least two stages including an initial stage wherein $V_1$ is between 100% and 105% of $V_2$ during a coiling of approximately 20% of the length of said strip, and a second stage wherein $V_1$ is between 105% and 110% of $V_2$.

16. The process of claim 15 including the step of braking said compressor roller after said final phase, whereby said roll is ejected from said space.

* * * * *

UNITED STATES PATENT AND TRADEMARK OFFICE

CERTIFICATE OF CORRECTION

PATENT NO. : 4,928,898

DATED : May 29, 1990

INVENTOR(S) : Audren YVES, et al

It is certified that error appears in the above-identified patent and that said Letters Patent is hereby corrected as shown below:

On the title page, item [73], Assignee's address, should read as follows:

--Isover Saint-Gobain, Courbevoie, FRANCE--

The firm or attorney of record has been omitted, it should read as follows:

--OBLON, SPIVAK, McCLELLAND, MAIER & NEUSTADT, P.C.--

Signed and Sealed this

Twenty-second Day of June, 1993

*Attest:*

Michael K. Kirk

MICHAEL K. KIRK

*Attesting Officer*

*Acting Commissioner of Patents and Trademarks*